US007175065B2

(12) United States Patent
Wey

(10) Patent No.: US 7,175,065 B2
(45) Date of Patent: Feb. 13, 2007

(54) NAILING GUN WITH A DUST-BLOWING DEVICE

(76) Inventor: Fwu-Lai Wey, No. 493, Yichang Rd. Taichung County 411, Taiping City (TW)

( * ) Notice: Subject to any disclaimer, the term of this patent is extended or adjusted under 35 U.S.C. 154(b) by 0 days.

(21) Appl. No.: 11/306,619

(22) Filed: Jan. 4, 2006

(65) Prior Publication Data

US 2006/0196910 A1 Sep. 7, 2006

(30) Foreign Application Priority Data

Jan. 7, 2005 (TW) ..... 94200404 U

(51) Int. Cl.
*B25C 1/04* (2006.01)

(52) U.S. Cl. ..... 227/130; 227/156

(58) Field of Classification Search ..... 227/8, 227/130, 156, 112; 408/67, 56, 59, 61
See application file for complete search history.

(56) References Cited

U.S. PATENT DOCUMENTS 4,197,886 A * 4/1980 MacDonald ..... 81/442
4,736,879 A * 4/1988 Yamada et al. ..... 227/130
5,829,660 A * 11/1998 White ..... 227/8
5,850,961 A * 12/1998 Braun et al. ..... 227/130
5,918,788 A * 7/1999 Moorman et al. ..... 227/8
5,927,584 A * 7/1999 Akiba ..... 227/130
6,196,331 B1 * 3/2001 Naito et al. ..... 173/169
6,247,626 B1 * 6/2001 MacVicar ..... 227/10
6,783,050 B2 * 8/2004 Ishizawa et al. ..... 227/130
7,044,090 B2 * 5/2006 Ohtsu et al. ..... 123/46 SC

* cited by examiner

*Primary Examiner*—Scott A. Smith
(74) *Attorney, Agent, or Firm*—Alan D. Kamrath; Nikolai & Mersereau, P.A.

(57) ABSTRACT

A nailing gun with a dust-blowing device, the dust-blowing device is attached to a side of the nailing gun and has an actuating device operated by pushing forward to actuate the dust-blowing device. Therefore, operation of the nailing gun with the dust-blowing device is in accordance with ergonomic to facilitate the use of the nailing gun.

1 Claim, 5 Drawing Sheets

NAILING GUN WITH A DUST-BLOWING DEVICE

BACKGROUND OF THE INVENTION

1. Field of the Invention

The present invention relates to a nailing gun, and more particularly to a nailing gun with a dust-blowing device that is operated in accordance with ergonomic to make operation convenient and to facilitate utility of the nailing gun.

2. Description of Related Art

A conventional nailing gun has fixing efficiency by projecting nails to position objects to a working face. Because the construction site is always in mess and covered with dust, the working face has to be cleaned first by a dust-blowing gun to make the objects fixed to precise positions. Therefore, an operator has to prepare both the nailing gun and the dust-blowing gun and to switch consequently during working so that equipment cost is increased and the nailing operation becomes troublesome. Moreover, two electric wires respectively attached to the nailing gun and the dust-blowing gun may tangle with each other and more operational troubles are incurred.

With reference to patent of U.S. public number cA1, a conventional nailing gun with a dust-blowing device is disclosed. The dust-blowing device is attached to a barrel of the nailing gun. An actuating device is mounted on a rear end of the nailing gun and a nozzle is attached to a front end of the mailing gun. When the nailing gun is held by one hand, the thumb presses the actuating device to move the piston to allow the air blowing out via the nozzle to remove dust.

However, the conventional nailing gun with a dust-blowing device still has drawbacks. Although the dust-blowing device cleans the dust, operation of the dust-blowing device is difficult because the thumb has to press hardly inward such that the operator can not hold the nailing gun stable and use it well. Moreover, the dust-blowing device also has a complex inner design and thus manufacturing process of the conventional nailing gun is complicated.

SUMMARY OF THE INVENTION

The main objective of the present invention is to provide a nailing gun with a dust-blowing device in combination so that the nailing gun has both nailing efficiency and dust-blowing efficiency to save equipment cost.

Another main objective of the present invention is to provide a nailing gun with a dust-blowing device, wherein the dust-blowing device can be operated conveniently.

Still another main objective of the present invention is to provide a nailing gun with a dust-blowing device, wherein the nailing gun combines with the dust-blowing device easily in manufacturing processes.

To achieve the foregoing main objectives, the nailing gun with the dust-blowing device comprises:

the nailing gun with two sides and a grip;

the dust-blowing device attached one side near the grip on the nailing gun and comprising:

a tube body longitudinally attached to the nailing gun and having a lower axial hole, an upper axial hole aligning to the lower axial hole and having a diameter larger than one of the lower axial hole, an interface between the upper axial hole and lower axial hole, a channel transversally defined in the tube body and communicated between the upper axial hole and an interior of the nailing gun; wherein, the upper axial hole has an inner thread and the tube body has a top and an annular recess defined at the top around the upper axial hole;

a piston shaft received inside the tube body and comprising a head, a rod perpendicularly attached to the head and moveably received inside the lower axial hole; wherein the rod has a distal end, a stop at the distal end having a diameter larger than the one of the lower axial hole, an engaging cutout defined on the rod, and two annular grooves defined on the rod to respectively engage two O-rings;

a spring sleeving the rod of the piston shaft, received inside the upper axial hole of the tube body and clamped between head of the piston shaft and the interface of the tube body to provide a restitution force to the piston shaft;

a bolt mounted on the top of the tube body and having two ends, a flange formed at one end, an outer thread defined at the other end, a ring recess defined between the flange and the outer thread, an outlet in form of a sunken hole defined axially near the flange, and a head recess defined axially at the other end having the outer thread to engage the head on the piston shaft; and an actuating device engaged the engaging cutout on the rod of the piston shaft and having a trigger extending backward for operation of pushing forward.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
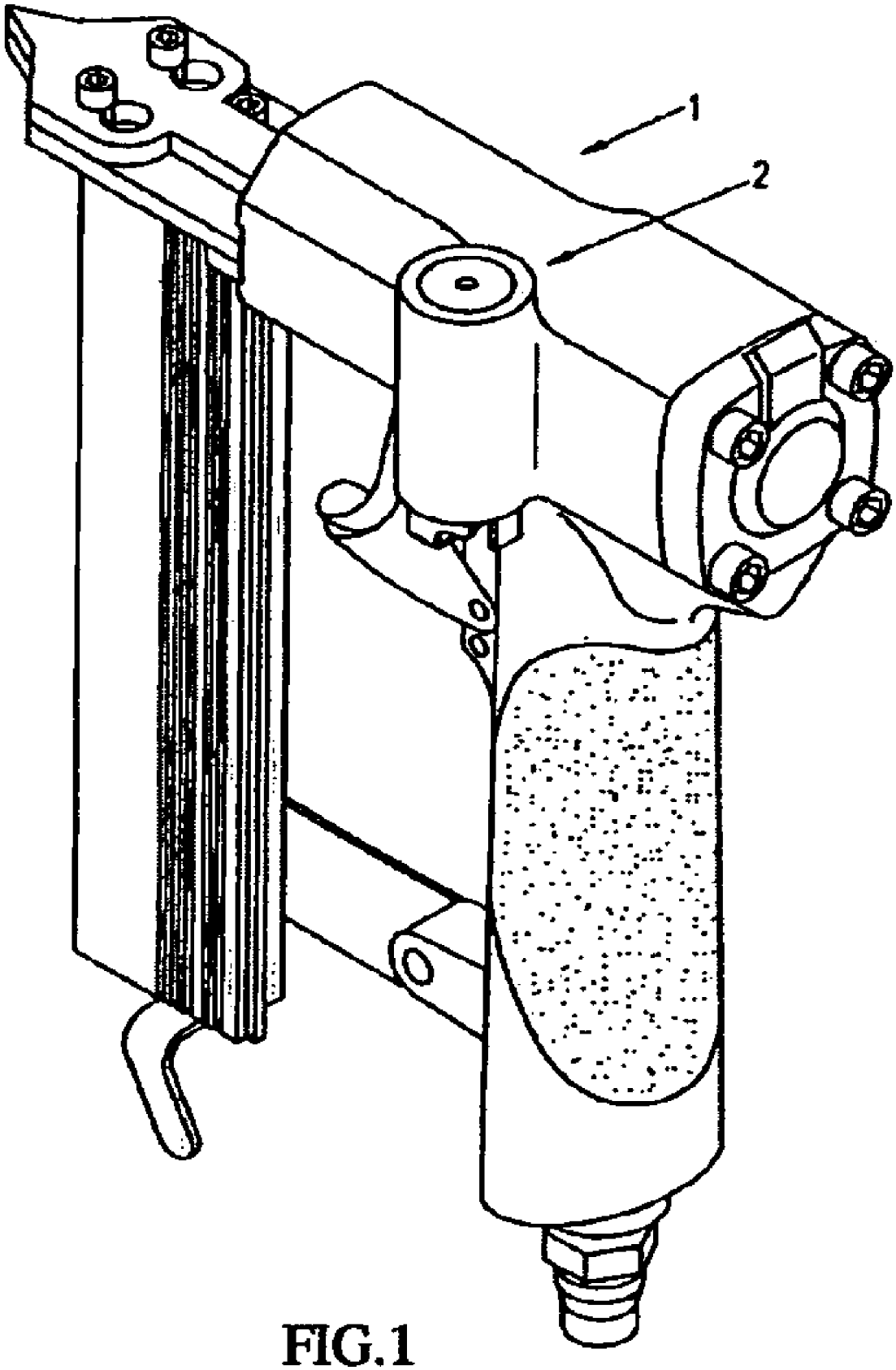
FIG. 1 is a perspective view of a nailing gun with a dust-blowing device in accordance with the present invention.

With reference to FIGS. 1 to 5, a nailing gun in accordance with the present invention comprises the nailing gun 1 with a barrel and a grip, and the dust-blowing device 2 mounted on a side of the nailing gun 1 near the grip.

The dust-blowing device 2 comprises a tube body 10 longitudinally attached to the barrel near the grip. The tube body 10 has a top, a lower axial hole 15, an upper axial hole 11 aligning to the lower axial 15 and having a diameter larger than one of the lower axial hole 15, and an interface 16 between the upper and lower axial holes 11, 15. The upper axial hole 11 has a threaded inner periphery 13 defined near the top of the tube body 10 and a channel 12 transversally extend to communicate interior of the nailing gun 1. By communicating the tube body 10 with the interior of the nailing gun 1, high-pressure gas for pushing nails out from the nailing gun 1 can be conducted to dust-blowing device to serve as cleaning gas. Moreover, An annular recess 14 is defined on the top of the tube body 10 around the upper axial hole 11.

A piston shaft 20 is received inside the tube body 10 and comprises a head 21 and a rod 22 perpendicularly attached to the head 21 and moveably received inside the lower axial hole 115. The rod 22 further has a stop 24 larger than the diameter of the lower axial hole 15, an engaging cutout 25 defined on the rod 22 over the stop 24 and two annular grooves 211, 221 defined on the rod 22 to respectively engage two O-rings 26, 27.

A spring 23 sleeves the rod 22 of the piston shaft 20, is received inside the upper axial hole 11 of the tube body 10 and clamped between head 21 and the interface 16 to provide a restitution force to the piston shaft 20.

A bolt 30 is mounted on the tube body 10 and has a flange 31 formed at one end, an outer thread 32 defined at the other end, and a ring recess 33 defined on the bolt 30 between the flange 31 and the outer thread 32. The bolt 30 has an outlet 35 in form of sunken hole defined axially near the flange 31 and a head recess 36 defined axially at the end with the outer thread 32 to engage the head 21 on the piston shaft 20.

An actuating device 40 is pivotally attached under the tube body 10 and has a trigger extending backward and an elongated hole movably engaged the engaging cutout 25 on the rod 22. By pushing the trigger forward, the dust-blowing device 2 is actuated.

Figure 2:
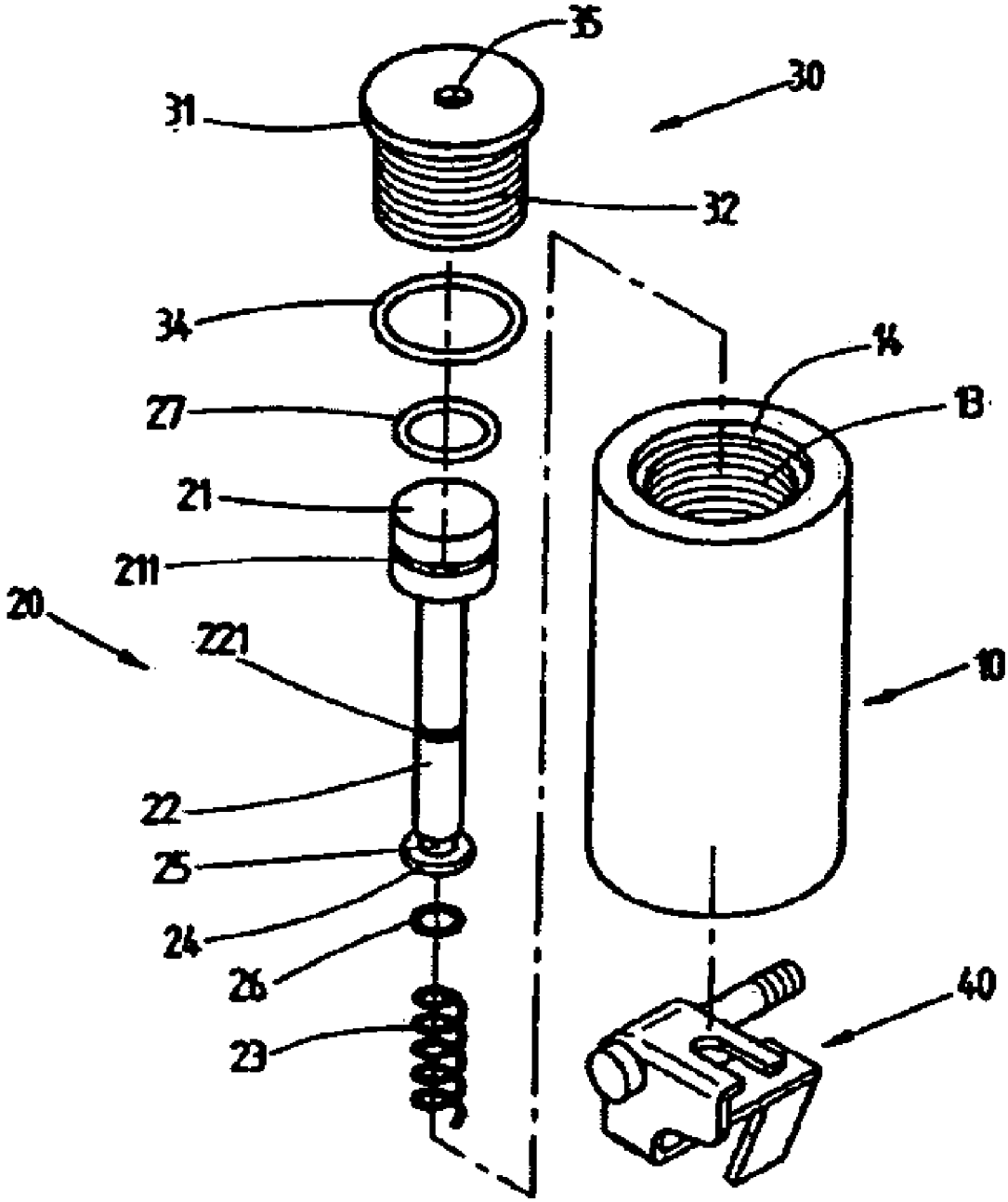
FIG. 2 is an exploded perspective view of the dust-blowing device in FIG. 1.
Figure 3:
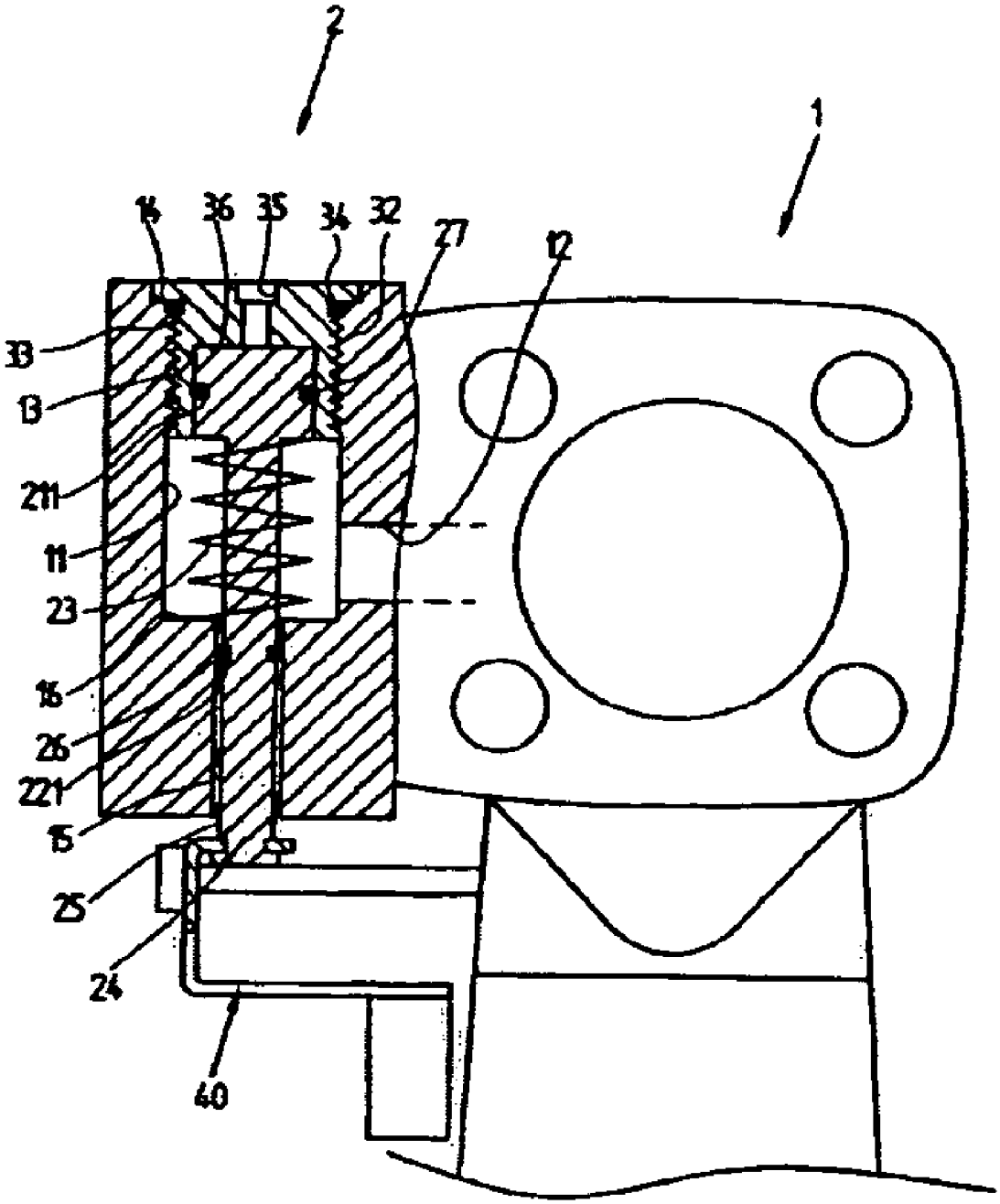
FIG. 3 is a cross-sectional view of the dust-blowing device in FIG. 1 before actuating.

When the dust-blowing deice 2 operates, as shown in FIGS. 2 and 3, the annular grooves 211, 221 on the head 21 and the rod 22 of the piston shaft 20 combine with the O-rings 26, 27. Then, the spring 23 sleeves the rod 22 and is clamped between the head 21 and the interface 16 of the tube body 10. The engaging cutout 25 on the rod 22 combines the actuating device 40 to make the actuating device 40 abut the tube body 10. Moreover, the ring recess 33 of the bolt 30 engages the O-ring 34 and screws into the upper axial hole 11 to make the flange 31 snugly combine the annular recess 14.

Figure 4:
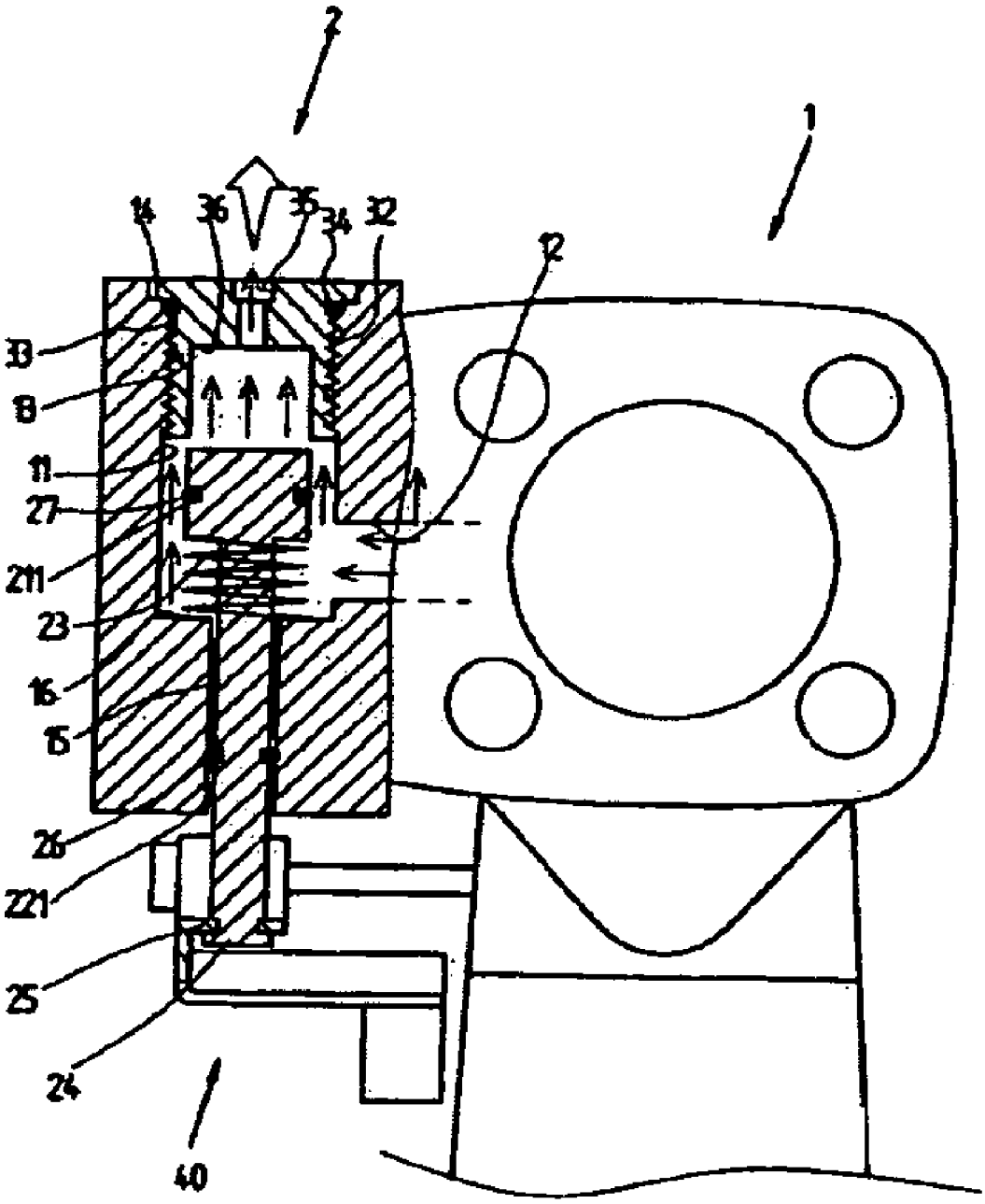
FIG. 4 is a cross-sectional view of the dust-blowing device in FIG. 1 after actuating.
Figure 5:
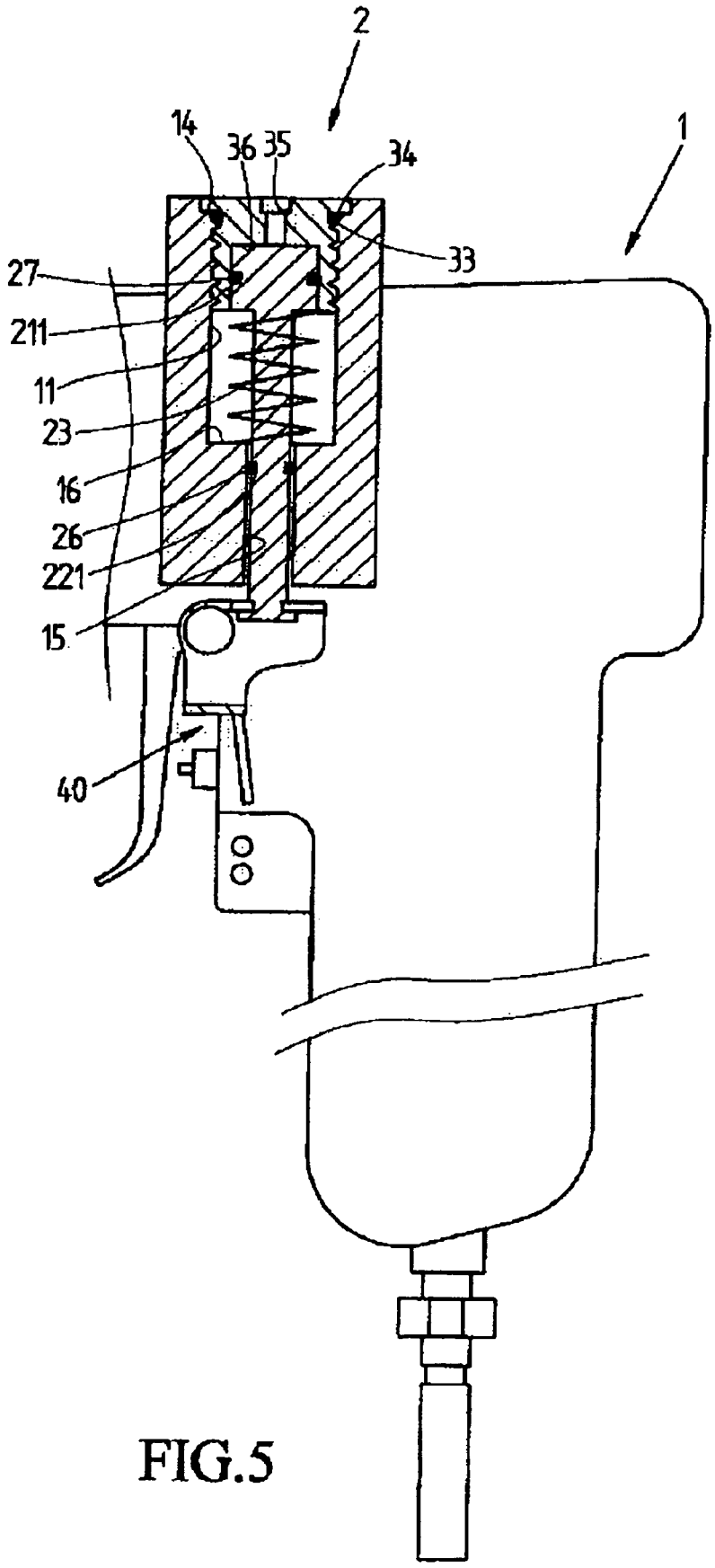
FIG. 5 is a cross-sectional side view of the dust-blowing device in FIG. 1.

According to above structure combination, as shown in FIGS. 3 to 5, the head 21 of the piston shaft 20 is received in the head recess 36 of the bolt 30. The O-ring 27 on the head 21 closes the head recess 36 and the O-ring 26 on the rod 22 also closes the lower axial hole 15 to keep the tube body 10 hermetical in a normal situation. When the actuating device 40 is pushed forward, the piston shaft 20 is driven downward to press the spring 23 and to perform gaps between the head 21 and the head recess 36 so that air bursts out of the tube body 10 via the outlet 35. When the dust-blowing device 2 is not needed, the actuating device 40 is released and the piston shaft 20 moves upward by the restitution force from the compressed spring 23 and back to the normal situation. Because the actuating device 40 is attached to one side of the nailing gun 1 to close a place where the thumb reaches, operation of the bust-blowing device 2 is easy.

According to above description, the nailing gun with the dust-blowing device in the present invention has the following advantages:

1. By combining the dust-blowing device with the nailing gun, the operator can achieve the nailing operation without buying the nailing gun and the dust-blowing device respectively so that equipment cost is significantly reduced.

2. The dust-blowing device 2 is attached to one side of the nailing gun 1 and operated by pushing actuating device 40 to drive the piston shaft 20, operation of the dust-blowing device 2 is in accordance with ergonomic and easy without hard effort.

3. Structure of the dust-blowing device is simple so that manufacturing and combination of the nailing gun with the dust-blowing device are convenient and rapid.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A nailing gun with dust-blowing device comprising:

the nailing gun with two sides and a grip;

the dust-blowing device attached at one side near the grip on the nailing gun and comprising:

a tube body longitudinally attached to the nailing gun and having a lower axial hole, an upper axial hole aligning to the lower axial hole and having a diameter larger than one of the lower axial hole, an interface between the upper axial hole and lower axial hole, a channel transversely defined in the tube body and communicated between the upper axial hole and an interior of the nailing gun; wherein, the upper axial hole has an inner thread and the tube body has a top and an annular recess defined at the top around the upper axial hole;

a piston shaft received inside the tube body and comprising a head, a rod perpendicularly attached to the head and moveably received inside the lower axial hole; wherein the rod has a distal end, a stop at the distal end having a diameter larger than the one of the lower axial hole, an engaging cutout defined on the rod, and two annular grooves defined on the rod to respectively engage two O-rings;

a spring sleeving the rod of the piston shaft, received inside the upper axial hole of the tube body and clamped between head of the piston shaft and the interface of the tube body to provide a restitution force to the piston shaft;

a bolt mounted on the top of the tube body and having two ends, a flange formed at one end, an outer thread defined at the other end, a ring recess defined between the flange and the outer thread, an outlet in form of a sunken hole defined axially near the flange, and a head recess defined axially at the other end having the outer thread to engage the head on the piston shaft; and an actuating device engaged the engaging cutout on the rod of the piston shaft and having a trigger extending backward and operated by pushing forward.

* * * * *